US005485801A

United States Patent [19]

Gibbs

[11] Patent Number: 5,485,801

[45] Date of Patent: Jan. 23, 1996

[54] APPARATUS AND METHODS FOR SHIELDING THE KEEL AND/OR BOW OF A WATERCRAFT

[76] Inventor: Ronnie D. Gibbs, 2415 S. Redwood Rd., Woods Cross, Utah 84087

[21] Appl. No.: 341,687

[22] Filed: Nov. 17, 1994

[51] Int. Cl.[6] ..... B63B 59/02

[52] U.S. Cl. ..... 114/219; 114/67 A

[58] Field of Search ..... 114/343, 364, 114/347, 67 R, 67 A, 288, 219; 244/130

[56] References Cited

U.S. PATENT DOCUMENTS

| | | | |
|---|---|---|---|
| 3,055,022 | 9/1962 | Vallquist | 9/1 |
| 3,220,026 | 11/1965 | Lichti | 9/1 |
| 3,374,495 | 3/1968 | Joyce | 114/219 |
| 4,751,891 | 6/1988 | Wilson | 114/219 |
| 4,762,080 | 8/1988 | Pearson | 114/343 |
| 4,865,271 | 9/1989 | Savill | 114/67 R |
| 4,909,172 | 3/1990 | Hamby | 114/219 |
| 4,986,496 | 1/1991 | Marentic et al. | 244/130 |

FOREIGN PATENT DOCUMENTS

| | | | |
|---|---|---|---|
| 0031640 | 3/1980 | Japan | 114/219 |
| 139369 | 6/1993 | Japan | 114/67 R |

*Primary Examiner*—Edwin L. Swinehart

*Attorney, Agent, or Firm*—Berne S. Broadbent; Gary D. E. Pierce; A. Jonn Pate

[57] ABSTRACT

An apparatus for shielding the keel and/or bow of a watercraft is disclosed in one presently preferred embodiment comprising a protective cover member having an elongated body substantially tapered in cross-sectional thickness from a midsection to at least two opposing sides. Protective cover member is preferably configured having one or more elongated channels formed therein. Preferably, the elongated channels are integrally formed in an exterior surface of the protective cover member and longitudinally disposed substantially parallel to the linear length of the protective cover member from a first end to a second end thereof. The protective cover member is preferably formed having an opposing contacting surface comprising a fastening means preferably disposed thereover for securing the protective cover member over the keel and/or bow of the watercraft. In current design, the tapered cross-sectional thickness of the body of the protective cover member in combination with the configuration of the elongated channels formed in the exterior surface of the protective cover member preferably provides means for creating turbulence in the water by forming pockets of air in the water which promote a hydroplane effect against the body of the watercraft, thereby improving the hydrodynamic flow of water across the keel and/or bow of the watercraft.

21 Claims, 2 Drawing Sheets

APPARATUS AND METHODS FOR SHIELDING THE KEEL AND/OR BOW OF A WATERCRAFT

BACKGROUND

1. The Field of the Invention

This invention relates to surface protection equipment for boats and, more particularly, to novel apparatus and methods for shielding the keel and/or bow of a watercraft from abrasive damage and which is capable of improving the hydrodynamic flow of water across the exterior surface of the watercraft.

2. The Background Art

Watercraft such as, for example, motorboats, jet skis, wave runners, yachts, sailboats, kayaks and canoes are generally formed of a fiberglass composite material which can become easily damaged or seriously scratched as a result of forcible impact or collision with sand, gravel, rocks or other obscure objects or debris found in water. Typically, when a watercraft is beached, removed from and/or launched into water, or while the watercraft is merely moving through the water, the lowermost portion of the hull of the watercraft (generally encompassing portions of the stem, bow, forefoot, keel and stern) is particularly susceptible to abrasion. Consequently, abrasive damage usually promotes corrosion and structural weakening of the hull of the watercraft. In addition, the bow of a watercraft may procure serious damage as a result of forcible contact with the docking platform where the watercraft is secured.

Traditionally, the keel and bow (inclusive of the stem and forefoot) of a watercraft are generally formed having a substantially arcuate shape which structurally encourages the hydrodynamic flow of water across the exterior surface of the hull as the watercraft moves through the water. The hydrodynamic performance of a watercraft, however, can be sufficiently reduced as a result of serious abrasions disposed on the keel and/or bow of the watercraft. In this regard, serious damage such as, for example, deep scratches, penetration or abrasions in the exterior surface of the hull of a watercraft, typically generate substantial dragging or suction forces acting against the motion of the immersed watercraft and, more importantly, can seriously affect the overall hydrodynamic performance of the watercraft in water. Moreover, serious abrasions in the hull of a watercraft particularly formed of fiberglass will generally necessitate the repair and/or replacement of the hull and those structural features of the body of the watercraft functionally affected.

The repair and/or replacement of the hull of a watercraft is customarily costly, and typically sorely inconvenient to the owner of the watercraft. Accordingly, the capacity for protecting the keel and/or bow of a watercraft from abrasive wear and tear, damage or deep scratching has encouraged significant concentration and development within the boating industry as to the various options available for protecting the hull of a watercraft and while reducing the cost of repair and maintenance of the exterior surface thereof, while substantially preserving the monetary value of the watercraft itself.

In an attempt to structurally accommodate the ability to protect at least a portion of the lowermost portion of a watercraft from structural damage caused by abrasion and deep scratching, those skilled in the art developed prior art bow protectors. A serious disadvantage associated with bow protectors of the prior art, however, is their general inability to adequately conform over the keel or bow of a particularly engineered keel or bow configuration or design of a specific make or model of watercraft.

Traditionally, prior art bow protectors are designed and manufactured as a preformed unit having a substantially rigid "V" shaped configuration. Moreover, the material comprising prior art bow protectors is usually only slightly deformable when disposed over the particular configuration of the bow or keel of the watercraft. In this regard, since the design and configuration of a hull of a watercraft is not universal in nature or in application with other watercraft, preformed prior art bow protectors are typically unable to provide sufficient universal conformity over the keel or bow of various sizes or shapes of watercraft. Similarly, because the manufacturing of prior art bow protectors in various shapes and sizes for different makes and models of watercraft can be economically impractical, prior art bow protectors are usually molded or preformed in conventional shapes and sizes which attempt to provide an approximate conformity over the keel or bow of the various watercraft upon installation.

Other practical disadvantages with bow protectors of the prior art have also emerged in relation to the installation of bow protectors over the keel or bow of the watercraft. For example, in order to properly install prior art bow protectors over a nonconforming keel or bow of a watercraft, at least two skilled installers are typically required who generally apply compression forces against the preformed body of the prior art bottom protector in order to bend or alter the shape of the bow protector to minimally conform over the keel or bow of the watercraft. In this regard, prior art bow protectors are generally installed by skilled technicians with special training in the installation process and having the necessary tools to minimize the various problems that may arise during the installation process.

Similarly, there are significant disadvantages associated with the reduction of the overall hydrodynamic performance of a watercraft as a result of nonconforming prior art bow protectors rigidly secured over the keel or bow configuration or design of a specific watercraft. For example, several bow protectors of the prior art are generally formed having a substantially empty chamber (defined by an epoxy adhesive and spacer blocks) disposed between the keel or bow of the watercraft and the internal surface of the prior art bow protector. This empty chamber essentially modifies the distinctively engineered configuration or design of the original keel or bow. In correlation therewith, by changing or modifying the particular shape and/or conformation of the keel or bow of the watercraft, the overall efficiency of the hydrodynamic flow of water provided by the original hull design of the watercraft can be significantly altered.

In addition to the foregoing disadvantages, prior art bow protectors generally promote hydrodynamic dragging or suction forces which act against the exterior surface of the keel or bow of the watercraft. Since prior art bottom protectors are commonly secured to the exterior surface of the watercraft by means of spacer blocks and an epoxy adhesive, when prior art bow protectors are unable to be substantially conformed over the configuration of the keel or bow of the watercraft, the force of the water resistance against the keel or bow of the watercraft as it moves through the water, typically overwhelms the securing means provided by the adhesive epoxy of the bow protector. In this regard, prior art bow protectors typically become detached from the exterior surface of the watercraft and correspondingly, reduce the hydrodynamic performance of the watercraft.

Furthermore, bow protectors of the prior art are usually formed of a clear plastic material comprising a molecular composition which can be sufficiently degraded as a result of persistent contact with ultraviolet light. Ultraviolet light typically breaks down or alters the chemical structure of the clear plastic material and generally results in the discoloration of the plastic to display a slightly yellowish tint. Moreover, long exposure to ultraviolet light can cause the clear plastic of prior art bow protectors to become separated from the surface of the watercraft as a result of the chemical breakdown of the adhesive applied to the backing of the prior art bow protector and the exterior surface of the keel or bow.

BRIEF SUMMARY AND OBJECTS OF THE INVENTION

In view of the foregoing, it is a primary object of the present invention to provide an apparatus and method for shielding the keel and/or bow of a watercraft which protects at least a portion of a longitudinally disposed exterior surface of a watercraft from abrasive damage and which is capable of improving the hydrodynamic flow of water across the exterior surface of the watercraft.

It is also an object of the present invention to provide an apparatus and method for shielding the keel and/or bow of a watercraft which is formed of a substantially resilient composite material having the inherent capability of being substantially conformable over the specific configuration of the keel or bow of various makes and models of watercraft, whereby having a universal application.

It is a further object of the present invention to provide an apparatus and method for shielding the keel and/or bow of a watercraft which is capable of providing sufficient rigidness to a protective cover member to withstand abrasive damage caused by sand, gravel, rocks and other obscure objects or debris found in water.

It is a still further object of the present invention to provide an apparatus for shielding the keel and/or bow of a watercraft having a plurality of elongated channels formed in an exterior surface of a protective cover member which are capable of providing flexibility for easy application of the protective cover member over the keel and/or bow of the watercraft.

It is an additional object of the present invention to provide an apparatus and method for shielding the keel and/or bow of a watercraft which does not require at least two technicians having special knowledge, skills or tools to properly install the present invention over the keel and/or bow of a watercraft.

It is likewise an object of the present invention to provide an apparatus and method for shielding the keel and/or bow of a watercraft which is capable of reducing the cost of repair and maintenance of the keel and/or bow of a watercraft.

Consistent with the foregoing objects, and in accordance with the invention as embodied and broadly described herein, one presently preferred embodiment of the apparatus for shielding the keel and/or bow of a watercraft comprises a protective cover member having an elongated body substantially tapered in cross-sectional thickness from a mid-section to at least two opposing sides. The protective cover member is preferably configured having one or more elongated channels formed therein. Preferably, the elongated channels are integrally formed in an exterior surface of the protective cover member and longitudinally disposed substantially parallel to the linear length of the protective cover member from a first end to a second end thereof. The protective cover member is preferably formed having an opposing contacting surface comprising a fastening means preferably disposed thereover for securing the protective cover member over the keel and/or bow of the watercraft. In current design, the tapered cross-sectional thickness of the body of the protective cover member in combination with the configuration of the elongated channels formed in the exterior surface of the protective cover member preferably provides means for creating turbulence in the water by forming pockets of air in the water which promote a hydroplane effect against the body of the watercraft, thereby improving the hydrodynamic flow of water across the keel and/or bow of the watercraft.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through the use of the accompanying drawings in which:

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1 through 3, is not intended to limit the scope of the invention, as claimed, but it is merely representative of the presently preferred embodiments of the invention.

The presently preferred embodiments of the invention will be best understood by reference to the drawings, wherein like parts are designated by like numerals throughout.

Figure 1:
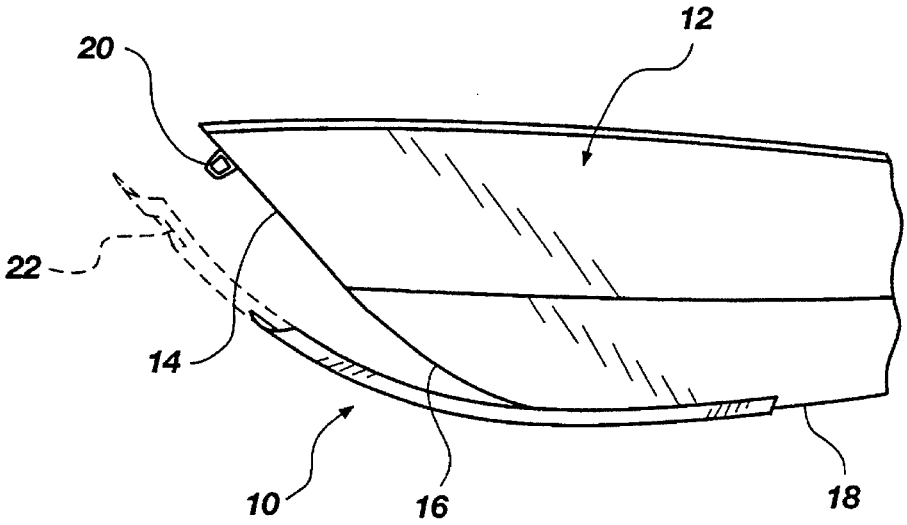
FIG. 1 is a perspective view of the apparatus for shielding the keel and/or bow of a watercraft in accordance with one presently preferred embodiment of the present invention.
Figure 2:
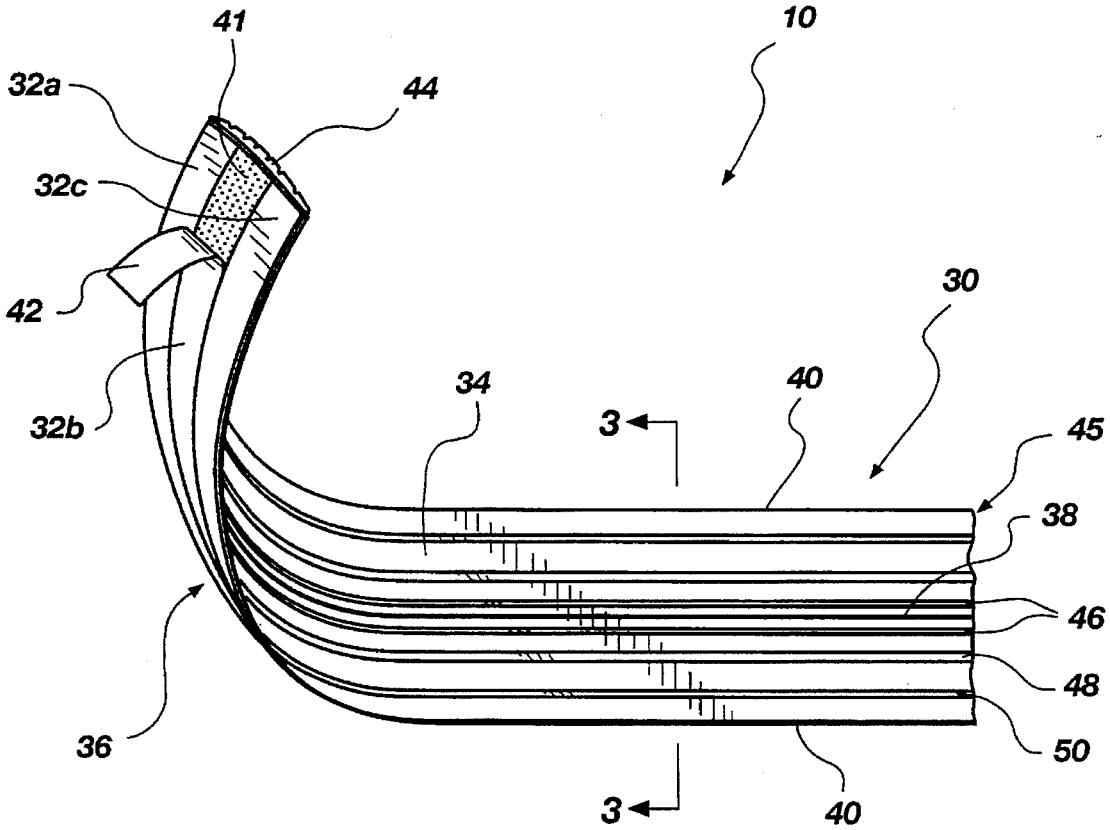
FIG. 2 is an elevated perspective view of one presently preferred embodiment of the apparatus for shielding the keel and/or bow of a watercraft as illustrated in FIG. 1.
Figure 3:
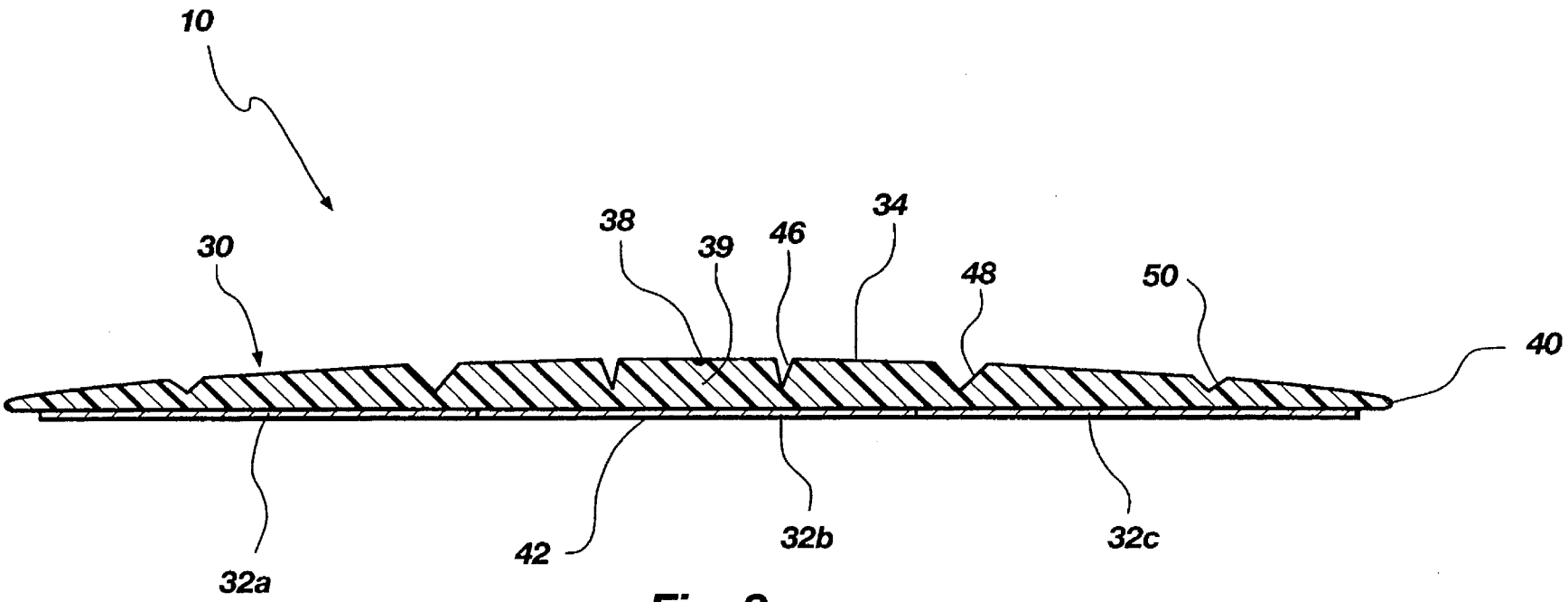
FIG. 3 is a cross-sectional view of one presently preferred embodiment of the apparatus for shielding the keel and/or bow of a watercraft as shown in FIG. 2.

One presently preferred embodiment of the present invention, designated generally at 10, is best illustrated in FIGS. 1 and 2. As shown, an apparatus for shielding the keel and/or bow of a watercraft 10 comprises a protective cover member 30 having an elongated body substantially tapered in cross-sectional thickness and preferably configured having one or more elongated channels 46, 48, 50 formed therein. Preferably, elongated channels 46, 48, 50 are integrally formed in an exterior surface 34 of protective cover member 30 and longitudinally disposed substantially parallel to the linear length of protective cover member 30 from a first end 44 to a second end 45 thereof. Moreover, protective cover member 30 is formed having an opposing contacting surface 36 having a securing means 41 preferably disposed thereover for securing protective cover member 30 over at least a portion of a longitudinally disposed exterior surface of a watercraft 12 such as, for example, a keel 16 and/or a bow 14.

Preferably, protective cover member 30 is formed of a resilient material sufficiently sturdy to withstand stress or force without permanent or serious deformation. For example, protective cover member 30 may be formed of plastic (any of numerous organic, synthetic or processed materials that are mostly thermoplastic or thermosetting polymers of high molecular weight that can be molded, cast, extruded, drawn or laminated), polyurethane resins, polycarbonate elastomers, styrene-butadiene thermoplastic elastomers, natural or synthetic rubber (i.e., polyurethane rubber), Polycor™, Tivar™ or any other suitable material providing sufficient resistance to withstand abrasion as a result of forcible impact with sand, gravel, rocks or any other obscure objects or debris found in water. It will be readily appreciated by those skilled in the art, however, that other suitable materials are possible which are consistent with the spirit and scope of the present invention.

Protective cover member 30 is preferably formed in a variety of colors which substantially correspond with the particular color of the keel 16 and/or bow 14 of watercraft 12 such as, for example, white, grey, sand, black, red, etc. The color variations of protective cover member 30 typically blend with and/or enhance the aesthetic appearance of watercraft 12. Accordingly, the material used to add color to protective cover member 30 preferably provides means for protecting the adhesive characteristics of securing member 32 from the substantial molecular and chemical degradations caused by the reaction between the adhesive and ultraviolet light. In an alternate embodiment, protective cover member 30 may be formed of a clear or translucent material which is consistent with the spirit and scope of the present invention.

In the presently preferred embodiment of the present invention for shielding the keel and/or bow of a watercraft, the mechanical and molecular properties of the material comprising protective cover member 30 preferably provides a substantially flexible protective cover member 30 when exposed to elevated temperatures such as, for example, the high temperatures produced by a heat gun or a hot air blower. In contrast, the mechanical and molecular properties of the material comprising protective cover member 30 preferably provides a substantially rigid protective cover member 30 when exposed to moderate or cold temperatures such as, for example, room temperature or normal water temperature, etc.

Because of the mechanical and molecular characteristics of the presently preferred material comprising protective cover member 30, protective cover member 30 is preferably formed having the capability of becoming sufficiently flexible or malleable when directly exposed to conditions of elevated temperatures (i.e., heat) and, more importantly, the capability of becoming substantially rigid and non-resilient under conditions of cold to moderate temperatures. Consistent therewith, the presently preferred embodiment of protective cover member 30 of the present invention provides means for conforming the linear shape of protective cover member 30 over at least a portion of keel 16 and/or bow 14 of watercraft 12 for installation thereover with the application of elevated temperatures thereto. Similarly, protective cover member 30 becomes preferably substantially rigid in conformation after installation over the portion of the longitudinally disposed exterior surface of watercraft 12, for example, keel 16 and/or bow 14, to provide means for withstanding abrasive damage to the exterior of watercraft 12 caused by forcible contact with sand, gravel, rocks or other obscure objects or debris when immersed in water.

Preferably, protective cover member 30 is formed having a substantially elongated body configured having a cross-sectional thickness substantially tapering in width from a midsection 39 to at least two opposing extension wings 40, as best illustrated in FIG. 3. In current design of the presently preferred embodiment of the present invention, midsection 39 of protective cover member 30 is formed having a cross-sectional thickness of approximately 0.5 centimeters (cm). Preferably formed on opposing sides or edges of midsection 39 of protective cover member 30 are extension wings 40 which are preferably configured having a cross-sectional thickness of approximately 0.16 cm. It will be readily appreciated by those skilled in the art, however, that other thicknesses, dimensions, shapes or configurations of protective cover member 30 are possible. In practice, the tapering cross-sectional thickness of protective cover member 30 in combination with elongated channels 46, 48, 50 provides means for improving the hydrodynamic flow of water across the exterior surface of watercraft 12 as it moves through the water.

Preferably, the linear length and peripheral width of protective cover member 30 various in accordance with the size and hull configuration of watercraft 12 to which apparatus for shielding the keel and/or bow of a watercraft 10 of the present invention is to be secured. For example, to properly shield the keel 16 of a conventional 26 foot watercraft 12 (7.92 meters), protective cover member 30 having a linear length of approximately 9 feet (2.74 meters) and a cross-sectional width of approximately 12.7 cm is preferably required. Accordingly, it will be readily appreciated by those skilled in the art that since the protective cover member 30 of the present invention must conform to the size of keel 16 and/or bow 14 of watercraft 12 to which it is to be applied, it is anticipated that the various structural elements thereof be formed in a series of different sizes and dimensions to accommodate different sizes and hull configurations of watercraft 12 in order to substantially shield keel 16 and/or bow 14 of watercraft 12.

Referring now to FIG. 1, an alternative preferred embodiment of the present invention provides protective cover member 30 having a linear length substantially sufficient to cover both keel 16 and bow 14 of watercraft 12. Moreover, in current design of one alternate preferred embodiment, an opening 22 is formed near a first end 44 of protective cover member 30 for introducing therethrough an eyehook 20 formed on the bow 14 of watercraft 12. In this regard, those skilled in the art will readily recognize that various portions of the longitudinally disposed exterior surface of the hull of watercraft 12 can be shielded by protective cover member 30 of the present invention either as a single member or as one or more independent sectional pieces.

In the presently preferred embodiment of the present invention, a plurality of elongated channels 46, 48, 50 are formed in exterior surface 34 of protective cover member 30, as illustrated in FIGS. 2 and 3. Preferably, elongated channels 46, 48, 50 are configured having a substantially "V" shaped configuration. It will be readily appreciated, however, that other shapes or configurations of elongated channels 46, 48, 50 are possible.

In current design, one presently preferred embodiment of the present invention comprises at least three complimentary pairs of elongated channels 46, 48, 50 longitudinally disposed substantially parallel to keel 16 and/or bow 14 of watercraft 12. The complimentary pairs of elongated channels 46, 48, 50 are preferably formed substantially outward and parallel to midsection 39 at approximately the same distance on opposing sides thereof. Preferably, elongated channels 46, 48, 50 are configured in such a manner so as to provide a plurality of conduits or pockets of air within the water between the exterior surface of keel 16 and/or bow 14 of watercraft 12. Accordingly, the pockets or conduits of air are substantially defined by the particular angular dimensions of elongated channels 46, 48, 50 which generally improve the hydrodynamic flow of water across the exterior surface of watercraft 12 as it moves through the water, as will be discussed in further detail below.

Referring now specifically to FIG. 3, a first pair of elongated channels 46 are preferably formed at a distance between approximately 0.2 cm and 2.0 cm from midsection 39 of protective cover member 30 and on opposing sides thereof. The first pair of elongated channels 46 are preferably formed with an opening substantially configured at an angle between approximately 5° and 55° and preferably comprising a cross-sectional width of between approximately 0.1 cm and 0.4 cm. In current design, the presently preferred embodiment of first pair of elongated channels 46 of the present invention is preferably formed having an angular opening configured at an angle of approximately 30°.

Preferably formed at a distance between approximately 0.8 cm and 4.5 cm from midsection 39 of protective cover member 30 and on opposing sides thereof is a second pair of elongated channels 48 having an opening substantially configured at an angle between approximately 50° and 120° and preferably comprising a cross-sectional width between approximately 0.3 cm and 0.8 cm. In current design, the presently preferred embodiment of the second pair of elongated channels 48 of the present invention is preferably formed having an opening configured at an angle of approximately 85°.

In addition, preferably formed at a distance between approximately 2.5 cm and 6.0 cm from midsection 39 of protective cover member 30 and on opposing sides thereof is a third pair of elongated channels 50 having an opening substantially configured with an angle between approximately 60° and 160° and preferably comprising a cross-sectional width between approximately 0.2 cm and 0.7 cm. In current design, the presently preferred embodiment of the third pair of elongated channels 50 of the present invention is formed having an opening configured at an angle of approximately 110°.

Consistent with the foregoing dimensions and angular configurations of elongated channels 46, 48, 50 of the present invention, it will be readily appreciated by those skilled in the art that other suitable dimensions, angular configurations or the number of elongated channels 46, 48, 50 are possible which are consistent with the spirit and scope of the present invention. For example, protective cover member 30 can be formed comprising one or more channels having substantially 90° angles. Furthermore, the angular dimensions of elongated channels 46, 48, 50 are preferably enlarged when conforming the shape of protective cover member 30 securely over a portion of keel 16 and/or bow 14. Furthermore, elongated channels 46, 48, 50 provide substantial flexibility to protective cover member 30 during installation when applied over keel 16 and/or bow 14.

In practice, when a solid body is substantially immersed within a fluid, the interaction of the forces acting on the exterior surface of the solid body and those forces acting in motion relative thereto, generally create a hydrodynamic effect between the immersed solid body and the fluid therearound. Accordingly, the movement of the solid body within the fluid is sufficiently frustrated by the collision of fluid molecules (relative to the viscosity of the fluid) and the molecular composition of the solid body. Consistent therewith, the less surface area of the solid body immersed within the fluid generally promotes a better hydrodynamic flow of fluid around the solid body, thus creating less resistance to the movement of the solid body through the fluid.

In accordance with the foregoing, the performance of a moving watercraft 12 substantially immersed within water is related to the effect of the hydrodynamic forces and flow of water therearound. In this regard, the particular angular dimension and cross-sectional width of elongated channels 46, 48, 50 contribute to improving the hydrodynamic flow of water across the exterior surface of watercraft 12 as the watercraft moves through the water.

In current design, when watercraft 12 is moving through water, a current of air generally impacts keel 16 and/or bow 14 of watercraft 12 and is preferably forced down through elongated channels 46, 48, 50 whereby creating a plurality of air pockets between the exterior surface of the hull of watercraft 12 and the water immersed therein. Consequently, these pockets of air provide a cushion of air which produces significant turbulence in the water whereby creating a hydroplane effect against watercraft 12 as it moves through the water. In this manner, the pockets of air forced within elongated channels 46, 48, 50 generally provide means for lifting watercraft 12 from the water, thus improving the hydrodynamic flow of water across keel 16 and/or bow 14 of watercraft 12 and sufficiently reducing any dragging or suction forces acting against watercraft 12.

Still referring to FIGS. 2 and 3, preferably formed in midsection 39 of protective cover member 30 and disposed longitudinally parallel to elongated channels 46, 48, 50 is an application guide 38. Preferably, application guide 38 comprises an elongated linear imprint or impression formed in or on exterior surface 34 of protective cover member 30. In current design, application guide 38 is preferably formed having a slightly darker coloration than protective cover member 30 to provide an indication of the approximate center of protective cover member 30 and provide assistance in the alignment and installation of protective cover member 30 over at least a portion of keel 16 and/or bow 14 of watercraft 12. It will be readily appreciated by those skilled in the art, however, that other suitable configurations or means for indicating the approximate center of protective cover member 30 are possible. For example, a wire, filament, thread or the like integrally disposed within midsection 39, a substantially "U" shaped linear conduit, an elongated channel, a pen mark, etc. are possible.

In one presently preferred embodiment of the present invention, preferably disposed on a contacting surface 36 of protective cover member 30 is a securing member 32. Securing member 32 preferably provides a securing means for permanently or removably securing protective cover member 30 over at least a portion of keel 16 and/or bow 14 of watercraft 12. In current design, securing member 32 comprises at least three complimentary strips of an adhesive tape **32*a*, 32*b*, 32*c* such as, for example, an acrylic foam self-adhesive tape manufactured by Minnesota Mining and Manufacturing Company (3M), Part No. 4229P for permanently securing protective cover member 30 over keel 16 and/or bow 14. Disposed over the adhesive surface of self-adhesive tape 32*a*, 32*b*, 32*c* is a protective backing 42 removably fastened thereto to retain the adhesive characteristics of securing member 32 until installation of protective cover member 30 over keel 16 and/or bow 14**. It will be readily appreciated, however, that other suitable materials such as, for example, an adhesive (of or relating to epoxy resins, vinyl acetate resins, polyurethane resins, rubber-based adhesives, butyl tape, polysulfide elastomers, elastomeric styrene-butadiene copolymers, elastomeric butadiene homopolymers, polycarbonate polymers or the like), nails, rivets, screws, bolts, tee-nuts, etc. are possible which are consistent with the spirit and scope of the present invention.

Referring now to the presently preferred method of the present invention for securing cover member 30 over at least a portion of keel 16 and/or bow 14 of watercraft 12 to protect keel 16 and/or bow 14 from abrasive damage and for improving the hydrodynamic flow of water therearound, comprises the steps of: (1) selecting a protective cover member 30 having a size sufficient to cover at least a portion of keel 16 and/or bow 14; (2) aligning protective cover member 30 over the portion of keel 16 and/or bow 14 by means of alignment guide 38; (3) manipulating protective cover member 30 so as to conform the shape of cover member 30 over the portion of keel 16 and/or bow 14; and (4) permanently securing protective cover member 30 over the portion of keel 16 and/or bow 14 of watercraft 12.

Pursuant to the foregoing, the presently preferred method of the present invention comprises additional steps of prepping the keel 16 and/or bow 14 of the watercraft for attaching securing member 32 of protective cover member 30. These steps include, for example: (1) removing the fiberglass mold release agent or any other contaminants formed on keel 16 and/or bow 14 of watercraft 12 so that the full bonding qualities of securing member 32 are realized; (2) roughing or etching at least a portion of the area of keel 16 and/or bow 14 of watercraft 12 to which protective cover member 30 is to be secured using for example, a Scotch Brite™ cleaning pad; (3) cleaning or removing debris from keel 16 and/or bow 14 using a sponge, soft cloth, etc. with a cleaning solvent such as, for example, alcohol, acetone, xylene, or any other suitable cleaning solution; and (4) removing any anti-fouling paint (formulated to absorb moisture so that barnacles will not stick or grow on the hull of the watercraft) from the portion of keel 16 and/or bow 14 where protective cover member 30 is to be applied by means of sanding or applying a paint remover to expose the original gel coat of watercraft 12.

After the portion of keel 16 and/or bow 14 are prepared for installation of protective cover member 30 in accordance with the foregoing steps, a section of backing 42 of securing member **32*b* at first end 44 of protective cover member 30 is preferably removed to expose a corresponding section of an adhesive surface 41 of securing member 32. Using application guide 38, first end 44 of protective cover member 30 is preferably aligned over the center of keel 16 and/or bow 14 for application of securing member 32 thereover. In this manner, contacting surface 36 of protective cover member 30 can be permanently secured to the center of the longitudinal length of keel 16 and/or bow 14 by means of securing member 32. Accordingly, one preferred method of the present invention for shielding the keel and/or bow of a watercraft, comprises the step of applying securing member 32*b* of protective cover member 30 over the linear length of keel 16 and/or bow 14 by means of alignment guide 38**.

After midsection 39 of protective cover member 30 is secured along the linear length of keel 16 and/or bow 14, backing 42 of securing members **32*a* and 32*c* is preferably removed in order to expose adhesive surface 41 of securing member 32 for contact over keel 16 and/or bow 14. In current design, heat is preferably applied to protective cover member 30 by means of a heat gun, hot air blower, etc. in order to manipulate the conformation of the body of protective cover member 30 in disposition over the configuration of the portion of keel 16 and/or bow 14 to be shielded. Pursuant thereto, protective cover member 30 is preferably formed having mechanical and molecular characteristics that allow protective cover member to become flexible under conditions of heat for purposes of installation. Moreover, the foregoing steps are preferably repeated until a second end 45 of protective cover member 30 is firmly attached over at least a portion of keel 16 and/or bow 14 of watercraft 12**.

In an alternative preferred method of the present invention for securing protective cover member 30 over a longitudinally disposed exterior surface of watercraft 12, the steps of securing protective cover member 30 over keel 16 and/or bow 14 preferably incorporate the application of second end 45 of protective cover member 30 over keel 16 and/or bow 14 before securing first end 44. Moreover, either side or extension wing 40 of protective cover member 30 may be secured to keel 16 and/or bow 14 first and followed by the application of midsection 39. Consistent therewith, it will be readily appreciated by those skilled in the art that other techniques or procedures for securing protective cover member 30 of the present invention over keel 16 and/or bow 14 are clearly possible.

From the above discussion, it will be readily appreciated that the present invention provides an apparatus and methods for shielding the keel and/or bow of a watercraft which protects at least a portion of a longitudinally disposed exterior surface of a watercraft from abrasive damage and which is capable of improving the hydrodynamic flow of water across the exterior surface of the watercraft. In addition, the present invention to provide an apparatus and method for shielding the keel and/or bow of a watercraft which is capable of providing sufficient rigidness to a protective cover member to withstand abrasive damage caused by sand, gravel, rocks and other obscure objects or debris found in water.

Unlike prior art bow protectors, the present invention provides an apparatus and method for shielding the keel and/or bow of a watercraft which is formed of a substantially resilient composite material having the inherent capability of being substantially conformed over the specific configuration of the keel or bow of various makes and models of watercraft, whereby having a universal application. Similarly, the present invention provides an apparatus for shielding the keel and/or bow of a watercraft having a plurality of elongated channels formed in an exterior surface of the protective cover member which are capable of providing flexibility for easy application of the protective cover member over the keel and/or bow of the watercraft.

Additionally, the present invention provides an apparatus and method for shielding the keel and/or bow of a watercraft which does not require at least two technicians having special knowledge, skills or tools to properly install the present invention over the keel and/or bow of a watercraft. Moreover, the present invention provides an apparatus and method for shielding the keel and/or bow of a watercraft which is capable of reducing the cost of repair and maintenance of the keel and/or bow of a watercraft.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. An apparatus for shielding at least a portion of a longitudinally disposed exterior surface of a watercraft from abrasive damage and for improving a hydrodynamic flow of water across said portion of said exterior surface of said watercraft, the apparatus comprising:

means for shielding said portion of said exterior surface of said watercraft, said shielding means having an elongated body, said elongated body having an exterior surface and an opposing contacting surface;

means for securing said contacting surface of said shielding means over said portion of said exterior surface of said watercraft; and means for reducing drag of said flow of water across said portion of said exterior surface of said watercraft, said drag reducing means comprising at least two elongated channels formed in said exterior surface of said shielding means, wherein each of said elongated channels comprises an angular configuration selectively diverse from said other elongated channel.

2. An apparatus for shielding at least a portion of a longitudinally disposed exterior surface of a watercraft as defined in claim 1 wherein said shielding means comprises a substantially resilient impact resistant material.

3. An apparatus for shielding at least a portion of a longitudinally disposed exterior surface of a watercraft as defined in claim 1 wherein said elongated body being substantially tapered in cross-sectional thickness from a midsection to opposing sides.

4. An apparatus for shielding at least a portion of a longitudinally disposed exterior surface of a watercraft as defined in claim 3 wherein said midsection having a cross-sectional thickness of approximately 0.5 centimeters.

5. An apparatus for shielding at least a portion of a longitudinally disposed exterior surface of a watercraft as defined in claim 3 wherein said opposing sides having a cross-sectional thickness of approximately 0.16 centimeters.

6. An apparatus for shielding at least a portion of a longitudinally disposed exterior surface of a watercraft as defined in claim 1 wherein said securing means comprises an adhesive.

7. An apparatus for shielding at least a portion of a longitudinally disposed exterior surface of a watercraft as defined in claim 1 wherein said drag reducing means further comprises a first complimentary pair of elongated channels, a second complimentary pair of elongated channels and a third complimentary pair of elongated channels longitudinally disposed in said exterior surface of said shielding means, wherein each of said complimentary pairs of elongated channels comprises an angular opening selectively diverse from said other complimentary pairs of elongated channels.

8. An apparatus for shielding at least a portion of a longitudinally disposed exterior surface of a watercraft as defined in claim 7 wherein said first pair of elongated channels having an angular opening between approximately 5° and 55°.

9. An apparatus for shielding at least a portion of a longitudinally disposed exterior surface of a watercraft as defined in claim 7 wherein said second pair of elongated channels having an angular opening between approximately 50° and 120°.

10. An apparatus for shielding at least a portion of a longitudinally disposed exterior surface of a watercraft as defined in claim 7 wherein said third pair of elongated channels having an angular opening between approximately 60° and 160°.

11. An apparatus for shielding at least a portion of a longitudinally disposed exterior surface of a watercraft from abrasive damage and for improving a hydrodynamic flow of water across said portion of said exterior surface of said watercraft, the apparatus comprising:

a shielding member for protecting said portion of said exterior surface of said watercraft, said shielding member having an elongated body substantially tapered in cross-sectional thickness from a midsection to opposing sides, said elongated body having an exterior surface and an opposing contacting surface;

a securing member formed over said contacting surface of said shielding member, said securing member providing means for securing said contacting surface of said shielding member over said portion of said exterior surface of said watercraft;

a first complimentary pair of elongated channels comprising an angular opening for reducing drag of said flow of water across said portion of said exterior surface of said watercraft; and a second complimentary pair of elongated channels comprising an angular opening for reducing drag of said flow of water across said portion of said exterior surface of said watercraft, said angular opening of said first pair of elongated channels being selectively diverse from said angular opening of said second pair of elongated channels.

12. An apparatus for shielding at least a portion of a longitudinally disposed exterior surface of a watercraft as defined in claim 11 further comprising an application guide formed adjacent said midsection of said elongated body, said application guide providing an indication of an approximate center of said shielding member.

13. An apparatus for shielding at least a portion of a longitudinally disposed exterior surface of a watercraft as defined in claim 11 wherein said shielding member comprising a substantially resistant material.

14. An apparatus for shielding at least a portion of a longitudinally disposed exterior surface of a watercraft as defined in claim 11 wherein said midsection of said cover member having a cross-sectional thickness of approximately 0.5 centimeters.

15. An apparatus for shielding at least a portion of a longitudinally disposed exterior surface of a watercraft as defined in claim 11 wherein said opposing sides of said cover member having a cross-sectional thickness of approximately 0.16 centimeters.

16. An apparatus for shielding at least a portion of a longitudinally disposed exterior surface of a watercraft as defined in claim 11 wherein said securing member comprises at least one strip of adhesive tape.

17. An apparatus for shielding at least a portion of a longitudinally disposed exterior surface of a watercraft as defined in claim 11 wherein said first pair of elongated channels comprises an angular opening of approximately 30°.

18. An apparatus for shielding at least a portion of a longitudinally disposed exterior surface of a watercraft as defined in claim 11 wherein said second pair of elongated channels comprises an angular opening of approximately 85°.

19. An apparatus for shielding at least a portion of a longitudinally disposed exterior surface of a watercraft as defined in claim 11 further comprising a third complimentary pair of elongated channels comprising an angular opening for reducing drag of said flow of water across said portion of said exterior surface of said watercraft, said angular opening of said third pair of elongated channels being selectively diverse from said angular opening of said first pair of elongated channels and said angular opening of second pair of elongated channels.

20. An apparatus for shielding at least a portion of a longitudinally disposed exterior surface of a watercraft as defined in claim 19 wherein said third pair of elongated channels comprises an angular opening of approximately 110°.

21. A method for securing a cover member selectively over at least a portion of a longitudinally disposed exterior surface of a watercraft for protecting said portion of said exterior surface of said watercraft from abrasive damage and for improving a hydrodynamic flow of water across said portion of said exterior surface of said watercraft, said method comprising the steps of:

selecting said cover member having a size sufficient to cover said portion of said exterior surface of said watercraft, said cover member comprising means for reducing drag of said flow of water across said portion of said exterior surface of said watercraft, said drag reducing means comprising at least two elongated channels formed in said exterior surface of said cover member, wherein each of said elongated channels comprises an angular configuration selectively diverse from said other elongated channel;

aligning said cover member over said portion of said exterior surface;

manipulating said cover member so as to conform the cover member over said portion of said exterior surface; and securing said cover member over said portion of said exterior surface of said watercraft.

* * * * *